United States Patent [19]

Shahum

[11] Patent Number: 4,783,981

[45] Date of Patent: Nov. 15, 1988

[54] APPARATUS FOR FORMING A TUBE FROM A METAL BAND

[75] Inventor: Christian J. Shahum, Marseilles, France

[73] Assignee: Shahum S.A.R.L., Marseilles, France

[21] Appl. No.: 852,618

[22] Filed: Apr. 16, 1986

[30] Foreign Application Priority Data

Apr. 17, 1985 [FR] France ..... 85 05914

[51] Int. Cl.[4] ..... B21C 1/22; B21C 3/02; B21D 5/10; B21D 9/05

[52] U.S. Cl. ..... 72/52; 72/137; 72/144; 72/177

[58] Field of Search ..... 72/51, 52, 134, 135, 72/144, 169, 176, 177, 368, 370, 478; 59/2; 228/31, 150, 151

[56] References Cited

U.S. PATENT DOCUMENTS

| | | | |
|---|---|---|---|
| 665,015 | 1/1901 | Kennedy | 72/144 |
| 716,555 | 12/1902 | King | 72/144 |
| 1,378,992 | 5/1921 | Berg | 72/176 |
| 1,708,872 | 4/1929 | Coates | 72/176 |
| 2,229,149 | 1/1941 | Wacker | 72/137 |
| 3,001,569 | 9/1961 | Gradt | 72/176 |
| 3,225,579 | 12/1965 | Chambers | 72/142 |
| 3,415,089 | 12/1968 | Ferchland | 72/60 |
| 3,970,233 | 7/1976 | Suchecki | 72/52 |
| 4,204,415 | 5/1980 | Braad et al. | 72/176 |
| 4,403,491 | 9/1983 | Wassen et al. | 72/52 |

FOREIGN PATENT DOCUMENTS

| | | | |
|---|---|---|---|
| 27234 | 5/1884 | Fed. Rep. of Germany | 72/144 |
| 597120 | 4/1932 | Fed. Rep. of Germany . | |
| 670145 | 2/1936 | Fed. Rep. of Germany . | |
| 2507447 | 12/1982 | France . | |

*Primary Examiner*—E. Michael Combs

*Attorney, Agent, or Firm*—Knobbe, Martens, Olson & Bear

[57] ABSTRACT

This invention relates to a die device for forming tube from a metal band, wherein the die comprises a long die block comprising, lengthwise and passing through it, a conduit comprising an inlet orifice of larger cross section and an outlet orifice of smaller cross section. The conduit converges from the inlet orifice towards the outlet orifice. At the level of the inlet orifice, the conduit is of a width slightly greater than that of said metal band. As the planar metal band passes through the conduit, it is formed by the interior surface, or generatrices, of the conduit into a tube of the desired configuration. Means are provided for creating tubes of differing cross-sectional shapes, such as a square, or a circular configuration. The die block is removably mounted on a carriage, which carriage is movable horizontally in front of a horizontal mandrel driven in rotation. The tube created by passage through the die block is wound around the mandrel. The mandrel is removable and each mandrel may be constructed of differing cross sections, such as circular or elliptical, depending upon the desired product. The carriage is mounted to pivot about a horizontal axis parallel to the mandrel and comprises means for positioning it in inclination, so that the tube issuing from the die block is tangential to said mandrel.

29 Claims, 7 Drawing Sheets

APPARATUS FOR FORMING A TUBE FROM A METAL BAND

BACKGROUND OF THE INVENTION

The present invention relates to a die device for forming a tube from a metal band, and means for drawing this tube through the die device and for wrapping the tube in the desired shape. The tubing formed by the present invention is not limited to any particular cross-sectional configuration or length. In addition, the longitudinal edges of the formed tubing are not necessarily joined to form a closed cross-sectional configuration.

The technical sector of the invention is that of tools employed in the manufacture of tubular objects, and in particular, articles of jewelry or the like.

Dies are known with which the metal is drawn for the purpose of transforming it into a wire of determined cross section. Devices are also known for manufacturing a tube by means of shaping rollers.

The present invention is concerned with providing a novel technique for making tubes into a predetermined cross section: circular, oval, polygonal, etc.

The object to be attained may be conceptualized as the manufacture of straight or curved tubes from a band of metal or alloy of common or precious metals. This manufacture is accomplished by one passage through the die block while said band is under tension permitting a joining of the edges of the band in a perfectly straight line. It is a further object of the invention to wind the tube in a circular, oval or other manner during the course of formation.

SUMMARY OF THE INVENTION

These objects are attained by the die device described herein for forming a tube from a metal band. The invention comprises a die block comprising a conduit comprising an inlet orifice of larger cross section and an outlet orifice of smaller cross section. The conduit and generatrices converge from the inlet orifice towards the outlet orifice. At the inlet orifice, the conduit is of width slightly greater than that of said metal band, so as to permit free passage of the metal band without twisting and distortion. The inlet orifice may conceivably be of any shape as long as it satisfies this requirement. The outer surface of the die block may be of polygonal cross section and the inlet orifice and the outlet orifice of the conduit open out on two plane faces parallel to each other and perpendicular to the longitudinal axis of said block.

In one embodiment of the invention, the die block comprises a guide fin extending over all or part of the length of the conduit and projecting thereinside, which fin is parallel to the longitudinal axis of said conduit. Its function is to guide the turned up edges of the metal band during drawing to obtain a rectilinear joint of said edges.

According to another embodiment, the die block comprises a removable guide plate fixed to that face of the block where the inlet orifice of the conduit opens out. This guide plate partially obstructs said orifice and comprises a rectilinear edge lying on the side of and in the vicinity of the longitudinal axis of the conduit and on which edge the metal band abuts. The function of this plate is to guide said band and to oppose the twisting thereof during drawing, to obtain a rectilinear joint of the edges of the band.

According to a further embodiment, the die block comprises two removable guide plates fixed to that face of the block where said inlet orifice of the conduit opens out. The guide plates almost totally obstruct said orifice and comprise a rectilinear edge so that said edges are located on either side of and in the vicinity of the longitudinal axis of the conduit. The edges of the two guide plates are spaced apart by a distance slightly greater than the thickness of the metal band. The function of these two plates is to guide said band and to oppose its twisting during drawing to obtain a rectilinear joint of the edges of the band.

At least one of the inlet orifice plates may comprise, on said rectilinear edge, a notch located level with the longitudinal axis of the conduit. The notch allows passage of a metal wire constituting a core about which the metal band winds during drawing to form a tube.

According to a further embodiment, the die block comprises, inside the conduit, a guide rod constituting a fixed core, coaxial to the conduit and borne by a support plate fixed to that part of the block where the inlet orifice of the conduit opens. The free end of said core extends slightly outside the outlet orifice of the conduit and has an outer contour parallel to the inner contour of said orifice. A space substantially equal to the thickness of the metal band is maintained between the core and the outlet orifice of the conduit, to allow passage of the metal band.

The angle formed by the wall of the conduit and the face where the outlet orifice of the die block opens out is rounded or beveled in order to avoid any tear of metal during the traction exerted on the band.

According to the invention, said die block is removably mounted on a carriage movable horizontally in front of a horizontal mandrel driven in rotation around which the tube is wound after issuing from the die block. The movable carriage is mounted to pivot about a horizontal axis parallel to the mandrel, and comprises means for adjusting the position so that the tube issuing from the die block is tangential to said mandrel.

The drive means for the mandrel may consist of a reduction-gear motor or a reduction gear motor/variable speed drive unit fixed to a rectangular base. The drive shaft of the reduction gear extends horizontally with respect to the base. Said base comprises, opposite the drive shaft, a headstock comprising a tip coaxial to the drive shaft of the reduction gear. The mandrel is placed between said reduction gear and said headstock. In other words, the mandrel is rotated by the drive shaft end of the reduction gear and is supported at its other end by the headstock. The tip of the headstock is mounted to move along its longitudinal axis in a horizontal housing reserved in said headstock, which comprises means for immobilizing the tip in position. By moving the tip of the headstock, the mandrel may be removed from the device. Also by adjustment of the tip, different mandrel lengths may be accommodated on the device.

The carriage is held in position by a support mounted adjustably on the base. This support may be moved towards or away from the mandrel and comprises means for immobilizing it in position with respect to the mandrel.

Said support is composed of a base plate and of two end uprights perpendicular to said plate. The carriage is composed of a die-holder plate comprising two sliding elements which cooperate with an assembly of two slide rails parallel to each other and anchored in two end pieces. The slide rail assembly is mounted to pivot about horizontal, coaxial shafts borne by the two end uprights of the support.

The carriage-holder slide assembly is mounted to be ajustable in height on the two uprights of the support, which uprights comprise holes distibuted over their height. Each pair of holes is capable of receiving the shafts about which said slide rail assembly pivots.

The means for positioning the carriage and the slide assembly in inclination consists of two stop screws screwed at the end of two support tabs mounted to pivot in the vertical direction on either of said uprights of the support. After pivoting to the described location, the tabs are immobilized in position and the stop screws are placed in contact with the adjoining end piece in which the slide rails are anchored, and, usually, on either side of the pivot axis of the slide assembly.

An embodiment of the mandrel comprises on its periphery, a groove helically wound with contiguous turns. Over the length of the mandrel, the cross section of the groove corresponds to that of the tube issuing from the die.

Another embodiment of the mandrel is used to make tubular objects with an elliptic contour. In this case, the mandrel comprises a central core on which are added two half-shells with semi-elliptic outer contour and means for assembling the half-shells and the core. The half-shells while in place on said core, are spaced apart from each other by a distance substantially equal to the width of the tube. After removal of the core, the elliptically-wound tube may be easily removed from the mandrel.

For securing the tube to the mandrel, the mandrel comprises, at one of its ends, a radial mortise adapted to receive a catch for holding the tube issuing from the die block. The catch comprises a hole through which the tube is passed and means for immobilizing the tube within said hole.

The die device according to the invention thus enables a tube to be made by drawing and rolling, without elongation of the band of metal or alloy of common or precious metals, in a perfectly straight line of join of the edges of the band, without twist or other defect.

BRIEF DESCRIPTION OF THE DRAWINGS

The invention will be more readily understood on reading the following description with reference to the accompanying drawings, in which:

FIG. 8 is a view in perspective of a die device according to the invention.

FIG. 9 is a schematic plan view of the device of FIG. 8, viewed looking down from above the device.

DETAILED DESCRIPTION OF THE INVENTION

Figure 1:
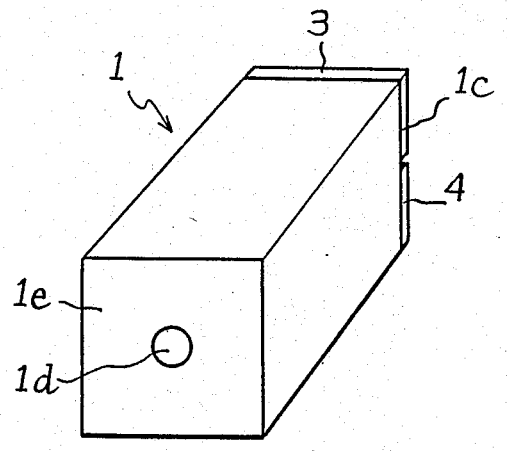
FIG. 1 is a view in perspective of a die block seen from the side of the outlet orifice.
Figure 2:
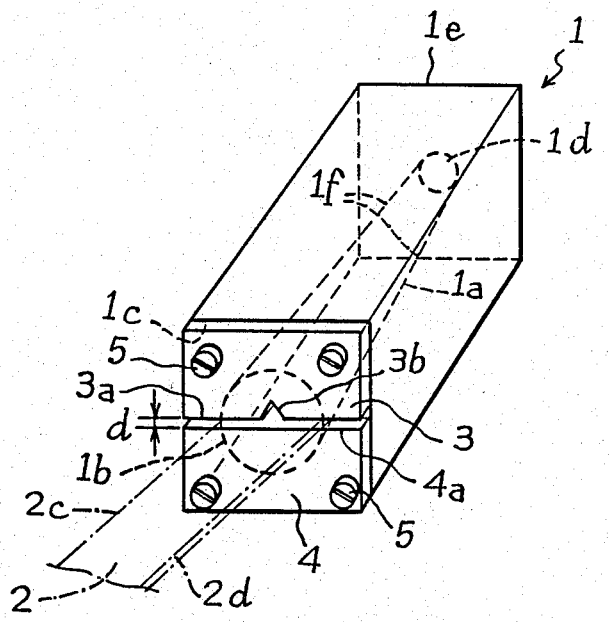
FIG. 2 is a view in perspective of a die block seen from the side of the inlet orifice.

Referring now to the drawings, FIGS. 1 and 2 both illustrate a die block 1 according to one embodiment of invention, in the form of a parallelepiped of square cross section. It will be noted that, without deviating from the principles of the present invention, said block may take any external shape and thus be of any polygonal section, even cylindrical.

Block 1 comprises, lengthwise, a conduit 1*a*, shown in FIG. 2, comprising an inlet orifice 1*b* of larger section, for example, circular, which opens out on a front face 1*c* of the block 1 and an outlet orifice 1*d*, of small circular section, which opens out on another face 1*e*, parallel to said face 1*c*. Orifices 1*b*, 1*d* are joined by generatrices 1*f* which converge from inlet orifice 1*b* towards the outlet orifice, with the result that the conduit is truncated in form.

The die block is designed to communicate to the metal band diverse forms in order to produce tubes of all shapes, for example, of circular, rectangular, square, triangular, star-shaped, heart-shaped or other cross section.

The shape of the tube is given by the outlet orifice 1*d*. The inlet orifice of said block is, in one embodiment, of circular cross section of which the diameter is slightly greater than the width of the metal band 2 which is shown in dot-dash lines in FIG. 2.

In the embodiment shown in FIGS. 1 and 2, the die block 1 comprises, on the inlet orifice 1*b* side and applied against the face 1*c* of the block, two rectangular plates 3 and 4 which are, for example, fixed by means of screws 5 screwed in tapped holes reserved in the die block. These plates comprise rectilinear edges 3*a*, 4*a* which are spaced apart from one another by a distance d substantially equal to the thickness of the metal band 2.

Figure 3:
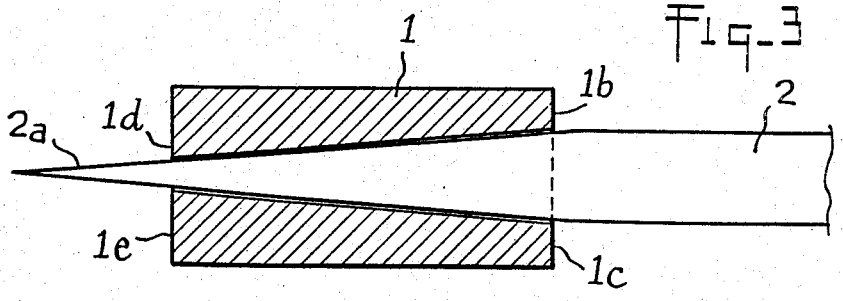
FIG. 3 is a view in longitudinal section through one embodiment of the die block illustrating the metal band formed in a point and positioned in the conduit before the operation of drawing of the band.

For making the tube, the band 2 is formed in a point, as illustrated in FIG. 3, and is passed between the two plates 3 and 4. The pointed end 2*a*, which emerges via outlet orifice 1*d*, is gripped by means of a clamp and the band 2 is drawn manually through the die so that the die gives the band the shape of the tube.

The shaping of the tube may be obtained manually by continuing to exert a manual tension on the metal band, or may be wound mechanically around a mandrel, as will be set forth hereinbelow.

One of the plates, for example, plate 3, may comprise a notch 3*b* made on the rectilinear edge 3*a*, which notch is in the form of a V, for example, and is in line with the longitudinal axis of the conduit of the conduit 1*a*. This notch allows passage of a metal wire (not shown) which constitutes a core around which the band of metal winds.

The function of the two plates 3 and 4 is to guide the band 2 and to oppose twist thereof during formation of the tube, to obtain a perfectly rectilinear joint of the edges of the band.

In the course of displacement of band 2 through conduit 1*a*, the lateral edges 2*c*, 2*d* of the band, guided by the conduit wall, are rolled towards each other. The edges abut on emerging through the outlet orifice 1*d* in the desired shape of the tube, which shape is communicated to the band by outlet orifice 1*d*. The edges may be actually joined together by a number of known methods.

The die block 1 may comprise only one plate and, in that case, the band 2 is guided solely by the rectilinear edge 3*a* of plate 3.

Figure 5:
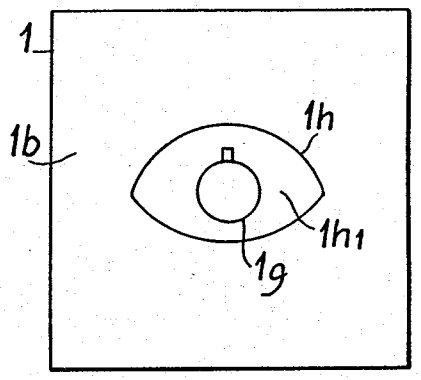
FIG. 5 is a view in direction F of the die block of FIG. 4.
Figure 4:
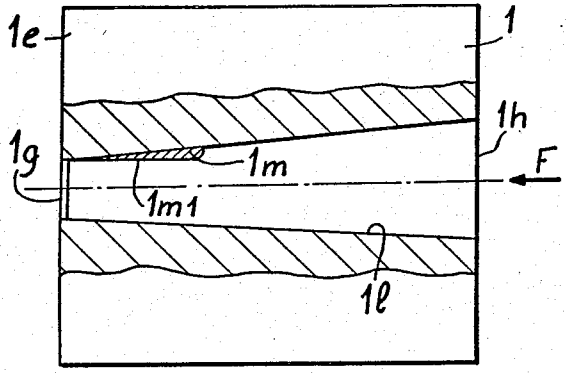
FIG. 4 is a view in elevation of a section of one embodiment of a die block comprising a fin for guiding the upturned edges of the band.
Figure 4A:
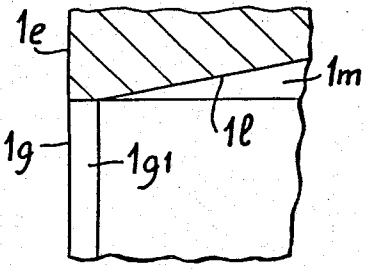
FIG. 4*a* is a view in section, on an expanded scale, of the outlet orifice of the die block of FIG. 4 illustrating the guide fin.

Another embodiment of the die block according to the invention, is shown in FIGS. 4 and 5. The die block 1 is similar to the one which has just been described with reference to FIGS. 1, 2 and 3 and is partially broken away to reveal conduit 1l. FIG. 4 is a view of the longitudinal cross section of this embodiment of die block 1, and FIG. 4*a* illustrates a portion of FIG. 4, showing an expanded view of the guiding fin. FIG. 5 illustrates the view from the inlet face 1*b* of this die block, through which the outlet orifice 1*g* can also be seen. In this embodiment, the outlet orifice 1*g*, which opens out on outlet face 1*e* is, for example, of circular cross section.

In this embodiment, inlet orifice 1*h*, which opens out on inlet face 1*b*, is generally elliptic in cross section, with the result that conduit 1*l* is generally trunconoidal in form. Inlet orifice 1*h* is such that its major axis $1h_1$ is slightly greater than the width of the metal band.

Referring to FIGS. 4 and 4*a*, conduit 1*l* comprises a small fin 1*m*, for example, 6/10th millimeter wide, which extends, for example, over part of the length of conduit 1*l* and projects thereinside. Said fin starts on the periphery of outlet orifice 1*g*, is of zero height at said orifice, and extends inwardly parallel to the axis of the conduit, progressing in height so that its longitudinal edge $1m_1$ is substantially perpendicular to face 1*g* of the die block. The function of this fin is to guide the upturned edges of the metal band during the drawing of the band through the tube to obtain a perfectly rectilinear joint of said edges.

Still referring to FIGS. 4 and 4*b*, the angle formed by the wall of conduit 1*l* and face 1*e* where outlet orifice 1*g* opens out, is rounded or beveled in order to avoid tear of metal during the drawing of the band from the die block. To this end, outlet orifice 1*g* comprises a flat portion $1g_1$, for example, 8/10th millimeter wide, and extending on the inner periphery of orifice 1*g*.

Figure 7:
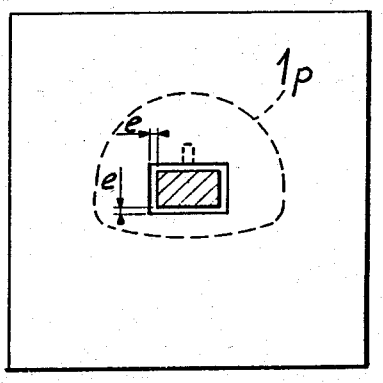
FIG. 7 is a view in direction $F_1$ of the die block of FIG. 6.
Figure 6:
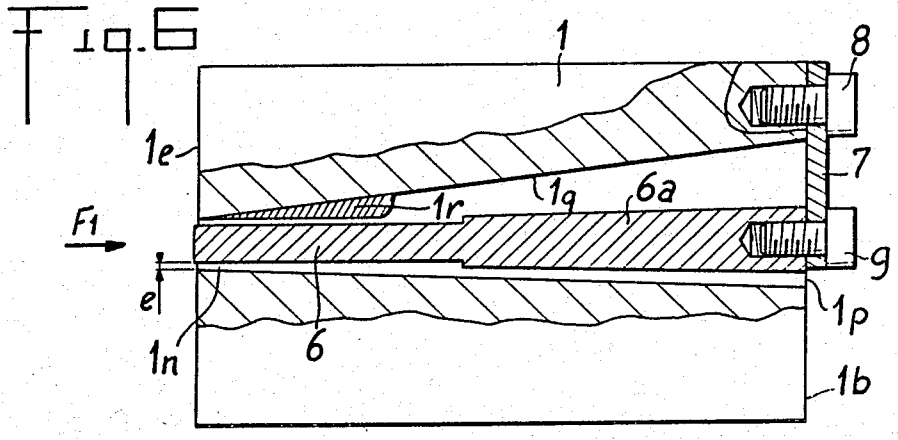
FIG. 6 is a view in elevation, partial section, of another embodiment of a die block comprising both a guiding fin and a core within the conduit, in particular for producing tubes of square or rectangular section.
Figure 5:
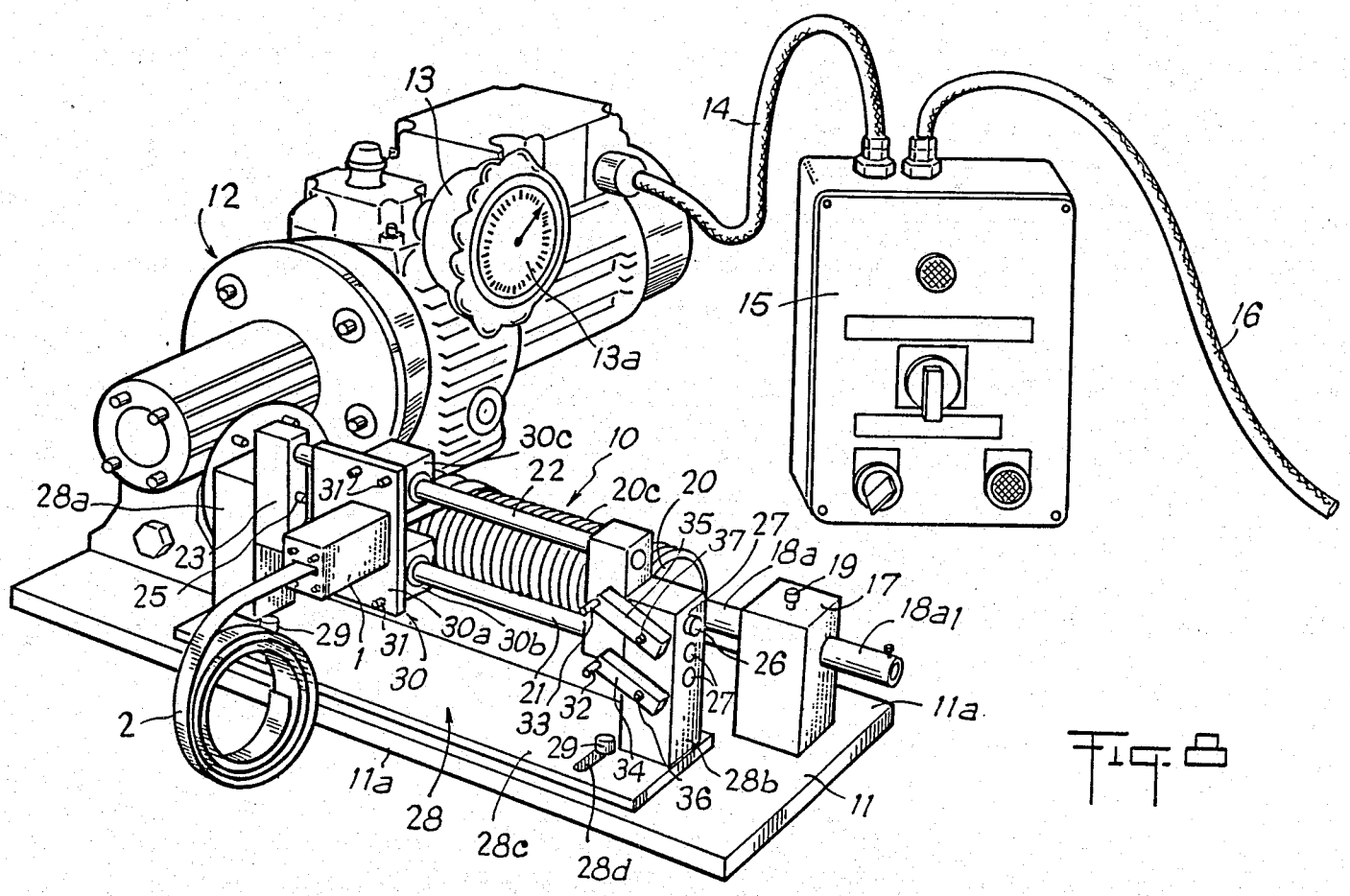
Figure 5:
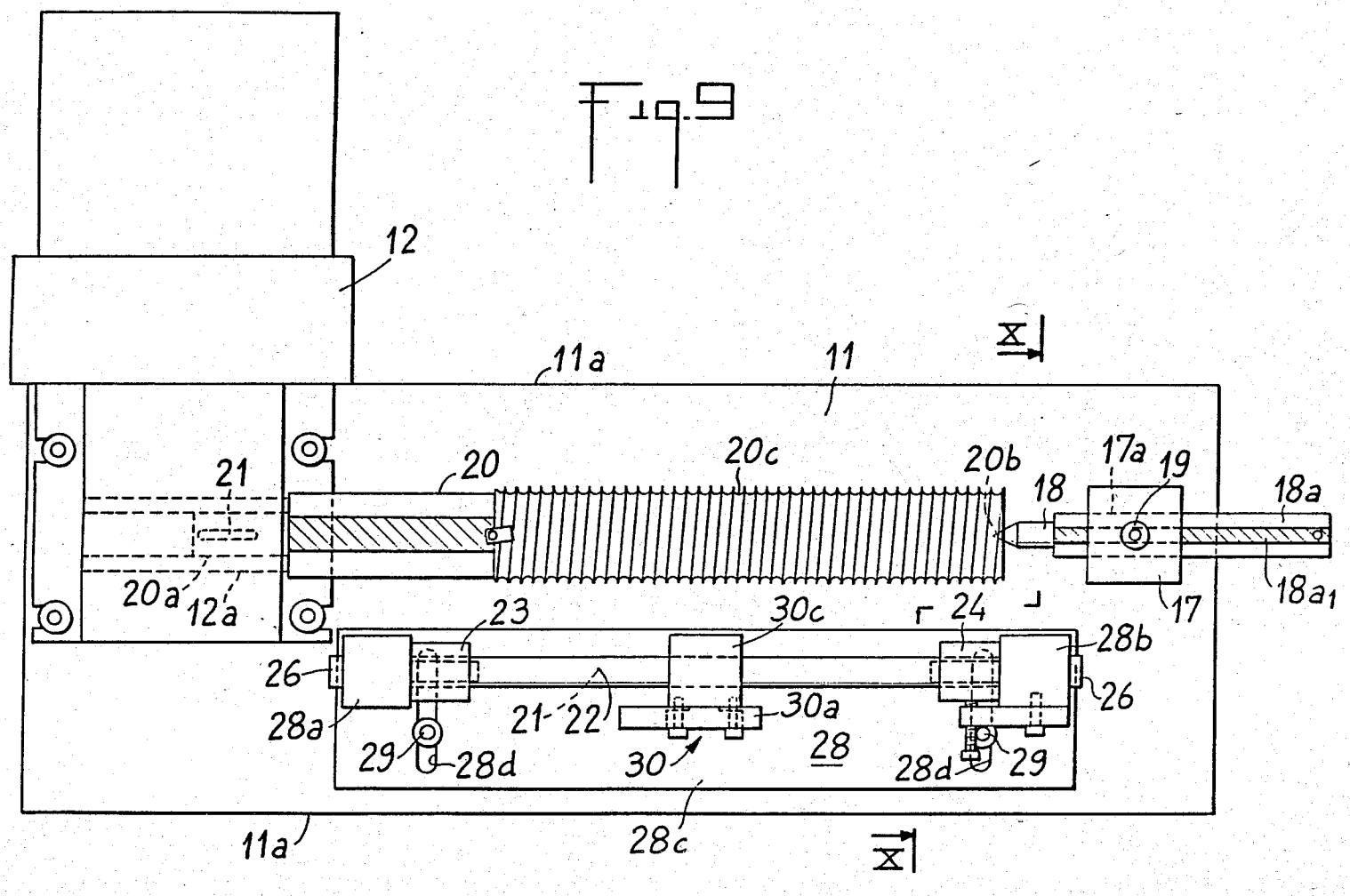

Another embodiment of the die block is illustrated in FIGS. 6 and 7. Die block 1 is similar in operation to those which have just been described with reference to FIGS. 1, 2, 3, 4 and 5. FIG. 6 is a view of the longitudinal cross section of this embodiment of the die block. FIG. 7 is an illustration of the outlet face 1*e* showing the outlet orifice 1*n*. This outlet orifice 1*n*, which opens out on face 1*e* is, for example, of rectangular cross section. Inlet orifice 1*p* is of rounded contour so that conduit 1*q* is of generally trunconoidal form.

The latter comprises a fin 1*r* identical in all respects to the fin 1*m* described with reference to FIG. 4.

Referring to FIGS. 6 and 7, the block comprises, inside conduit 1*q*, a guide rod 6 which constitutes a fixed core coaxial to conduit 1*q* and extending over about half the length of the block. Core 6 extends into a rod 6*a* of larger section, fixed to a rectangular support plate 7, which plate is in turn fixed to block 1 by means of screws 8, for example, two in number. Support plate 7 is placed on face 1*b* where inlet orifice 1*q* opens out. The core 6 and 6*a* is perpendicular to plate 7 and is fixed thereto by means of screws 9.

Plate 7 is fixed on the same upper side of the conduit as fin 1*r* so as to not interfere with the drawing of the band through the conduit.

In the embodiment shown in FIGS. 6 and 7, core 6 is of rectangular cross section and its outer contour is parallel to the inner contour of outlet orifice 1*n* of the conduit. FIG. 7 shows clearly a space e whose value is substantially equal to the thickness of the metal band, reserved between core 6 and the outlet orifice 1*n* in order to allow passage of the tube leaving the die block. Core 6 projects slightly outside orifice 1*n*, its function being to finish formation of the tube accurately. Fin 1*r* makes it possible to obtain, as has already been set forth hereinabove, a perfectly rectilinear joint of the edges of the band.

Figure 10:
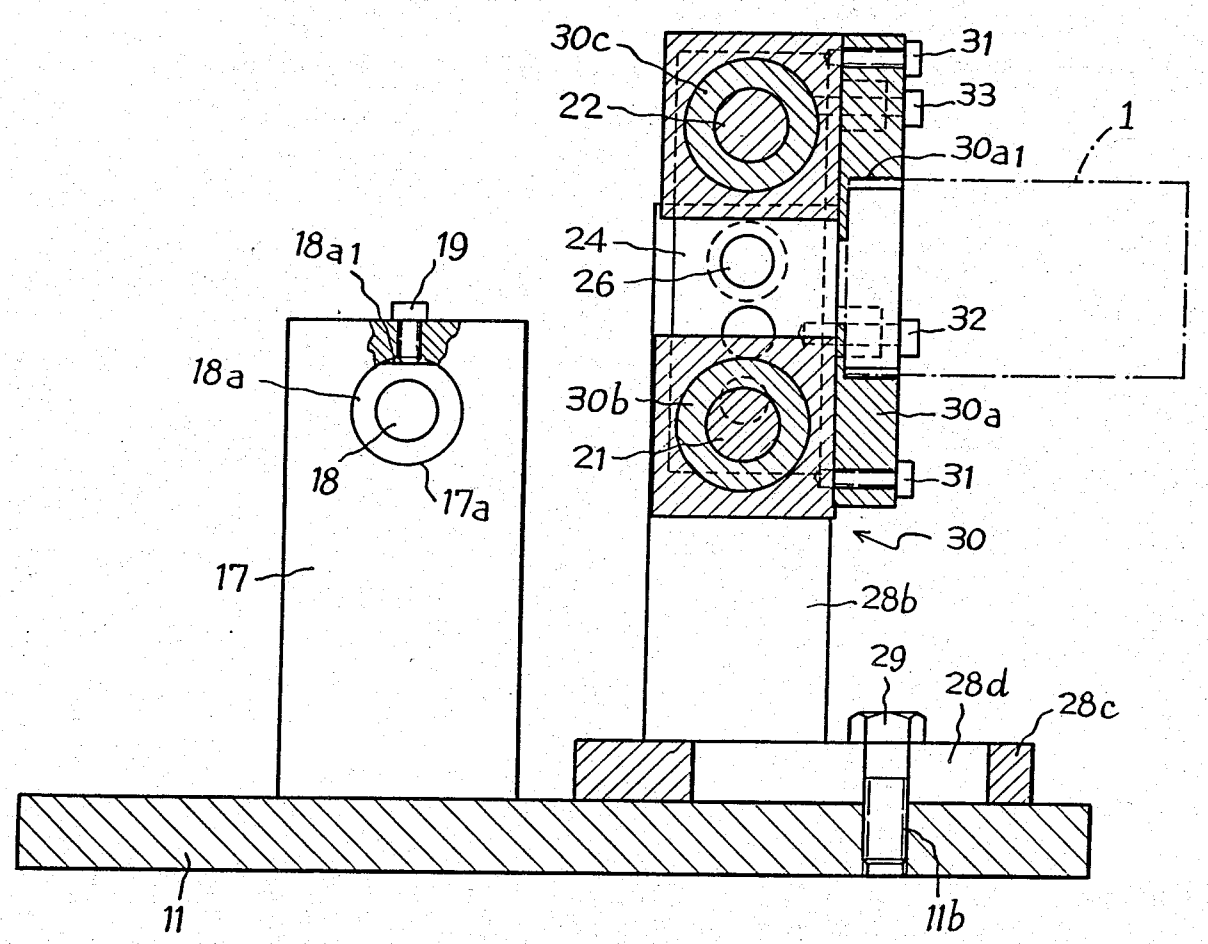
FIG. 10 is a view in section along line X—X of FIG. 9.

Reference will now be made to FIGS. 8, 9 and 10 of the drawings, which illustrate a die device 10 for drawing the tube issuing from the die block 1, by rolling it around a rotatable mandrel.

Referring to FIG. 8, this die device comprises a rectangular base 11 on which is mounted, at one end, a reduction gear motor, or a reduction gear motor/variable speed drive unit 12, extending at right angle with respect to base 11 and projecting at that angle with respect thereto. As is known, the variable speed drive unit comprises a control member 13 with dial 13*a*, which gives indications for calibrating the machine as a function of the actual revolutions of the drive shaft of the reduction gear motor. The motor is connected, via a cable 14, to a control box 15, itself connected to the mains by another cable 16.

Referring now to FIG. 9, the drive shaft 12*a* of reduction gear motor 12 is hollow and extends horizontally and parallel to the longitudinal edges 11*a* of base 11.

Opposite the drive shaft 12*a* of the reduction gear motor, base 11 comprises a headstock 17 which in turn comprises a tip 18 coaxial to shaft 12*a* of the reduction gear motor. Tip 18 is adjustably mounted in the headstock 17, in a horizontal, cylindrical housing 17*a*, which passes through the headstock lengthwise of the base 11. Tip 18 extends into a cylindrical spindle 18*a*, having the same diameter as the cylindrical housing 17*a* of the headstock 17, which spindle comprises a flat portion $18a_1$. Adjustment of the position of tip 18 on headstock 17 is obtained by means of a set screw 19 screwed in a tapped hole made in the upper part of headstock 17.

Between headstock 17, and the reduction gear motor 12, there is disposed a removable mandrel 20 which comprises, at one end, a shaft end 20*a* which penetrates in the hollow drive shaft 12*a* of the reduction gear, rotation being effected via a keyed interconnection 21. The hollow drive shaft 12*a* comprises, in known manner, a longitudinal groove in which is engaged a key integral with the shaft end 20*a* of the mandrel. At its other end, the mandrel comprises a conical hole 20*b*, into which penetrates tip 18 of the headstock.

The outside shape of mandrel 20 is a function of the objects which it is desired to obtain. For manufacturing circular tubular rings, mandrel 20 is cylindrical. The mandrel is smooth in the case of manufacturing objects having a square or rectangular cross section. For manufacturing rings of circular cross section, the mandrel comprises, on its periphery and over virtually the whole of its length, a helically wound groove 20*c* with contiguous turns whose section corresponds to the outer dimensions of the tube, producing a scalloped configuration. This groove makes it possible to obtain a regular winding of the tube issuing from the die block 1.

Level with the mandrel 20, and parallel thereto, there is an assembly of two slide rails 21, 22 which are horizontal and parallel to each other and are set in two end pieces 23, 24. (See FIGS. 8 and 9). This assembly, which takes the form of a rectangle, is mounted to pivot about two horizontal, coaxial shafts 25, 26 which shafts are engaged in holes 27 made in the two uprights 28*a*, 28*b* of a support 28, in abutment on base 11. This support 28 is composed of a rectangular base plate 28*c*, at the ends of which are fixed said uprights 28*a*, 28*b*, which are perpendicular to said plate 28*c*.

The support is movably mounted in order to be able to move closer to or away from mandrel 20. (See FIGS. 8, 9 and 10). To this end, base plate 28*c* comprises two slots 28*d*, located close to uprights 28*a*, 28*b*, and perpendicular to the longitudinal edges of plate 28*c*. Support 28 is maintained in position on base 11 by two screws 29 passing through slots 28*d* and screwed into tapped holes 11*b* made in base 11.

Referring now to FIGS. 8 and 10, slide rail assembly 21, 22 is adjustable in height in order to be able to position it as a function of the size of mandrel 20. Such adjustment is rendered possible by a plurality of holes 27 distributed over the height of uprights 28*a*, 28*b* and into which shafts 25, 26, are passed.

On slide rail assembly 21, 22 there is slidably mounted, a carriage 30, which is thus movable horizontally in front of said mandrel 20. This carriage is composed of a die-holder plate 30*a* to which are fixed two sliding elements 30*b*, 30*c* by means of screws 31. To facilitate slide of carriage 30 on slide rails 21, 22, the sliding elements 30*b*, 30*c* are of the linear rolling-type.

The die-holder plate 30*a* comprises a housing $30a_1$ of square section adapted to receive the die block 1 which is of corresponding cross section.

So that the tube, after issuing from die block 1, which extends substantially perpendicularly to edge 1*e* of said block where the outlet orifice opens out, may be tangential to the mandrel, the slide rail 21, 22 and carriage assembly 30 is mounted to pivot about shaft 26 inserted in hole. Carriage 30 and the slide rail assembly 21, 22 are positioned in inclination by two stop screws 32, 33 screwed in tappings made at the end of two support tabs 34, 35 mounted to pivot in a vertical plane about two screws 36, 37 screwed in the upright 28*b* of the support 28. This can be seen best in FIG. 8, and also is shown in FIG. 9.

In order to set the slide rail assembly 21, 22 and the carriage 30 in the desired inclination, the support tabs 34, 35 are positioned by pivoting them about screws 36, 37, which were previously loosened so as to place the stop screws 32, 33 on either side of the pivot axis 26. Screws 36, 37 are then tightened and stop screws 32, 33 are manipulated until said slide rail assembly bearing the carriage 30, is positioned at the desired inclination.

Figure 13:
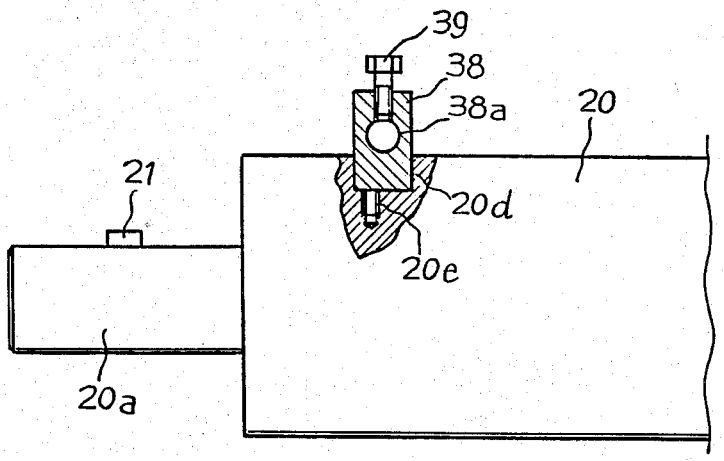
FIG. 13 is a partial elevational view of a mandrel illustrating one embodiment of a catch for drawing the tube, seen in section.
Figure 14:
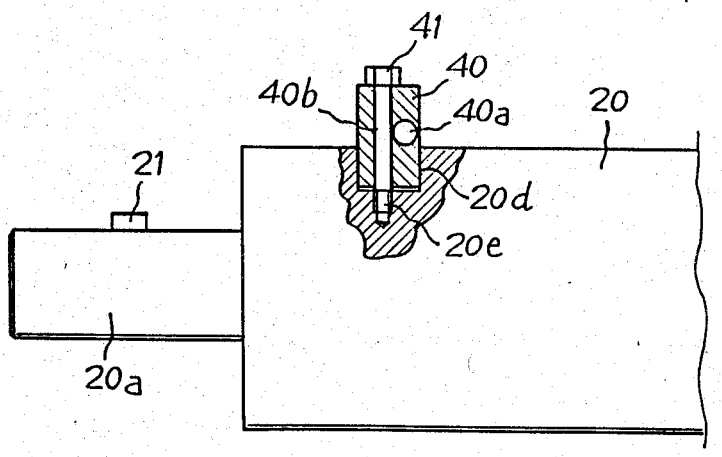
FIG. 14 is a partial elevational view of a mandrel illustrating another embodiment of a catch for drawing the tube, seen in section.

The tube, firstly formed by manual pulling or pushing through die block 1, is affixed to mandrel 20 by means of a drive catch, of which two embodiments are given in FIGS. 13 and 14. A good illustration of a mandrel appears in FIG. 9.

Referring now to the embodiment of FIG. 13, mandrel 20 comprises at its end located towards the drive shaft end 20*a*, a radial mortise 20*d* of rectangular cross section corresponding to that of catch 38. This catch is in the form of a small right-angled parallelepiped and comprises a hole 38*a*, passing through it. The free end of the tube is passed through the hole, and the tube is then fixed to catch 38 by means of a set screw 39.

In the embodiment of FIG. 14, catch 40, similar to catch 38, comprises a hole 40*a* passing through it, through which is passed the tube. Locking screw 41 is passed through a second hole 40*b*, perpendicular to hole 40*a*, and then is screwed in a tapped hole 20*e* made in the bottom of the mortise 20*d*. Upon tightening screw 41, the catch 40 is moved downward in mortise 20*d*, which results in the constraining of the tube between catch 40 and the periphery of mandrel 20.

After affixation of the tube to the mandrel, the reduction gear motor is then actuated to drive the mandrel in rotation and the tube issuing from die 1 will wind around the mandrel in contiguous turns. As a result of the freely sliding assembly of carriage 30, the tube may be wound over the length of mandrel 20.

The die block 1 is maintained engaged in housing $30a_1$ of the carriage under the effect of the tension exerted on the tube.

Figure 11:
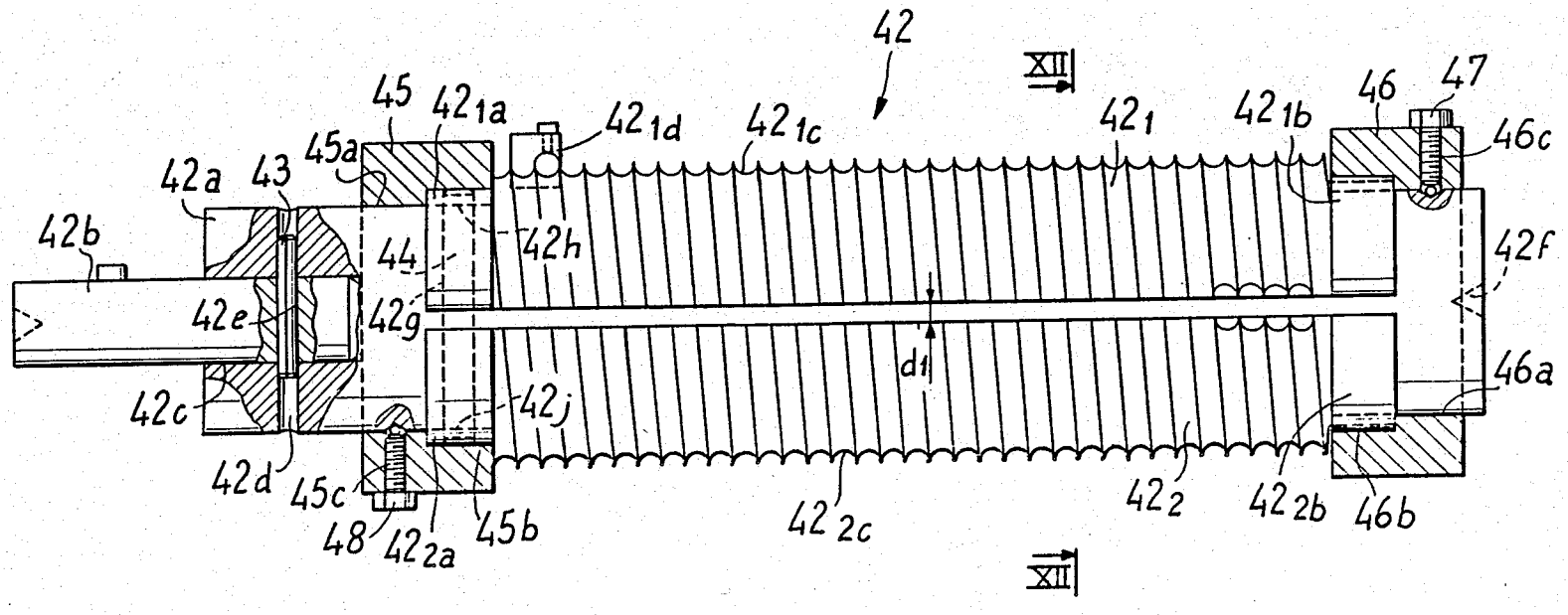
FIG. 11 is a view in elevation of a mandrel for making objects with an elliptic contour.
Figure 12:
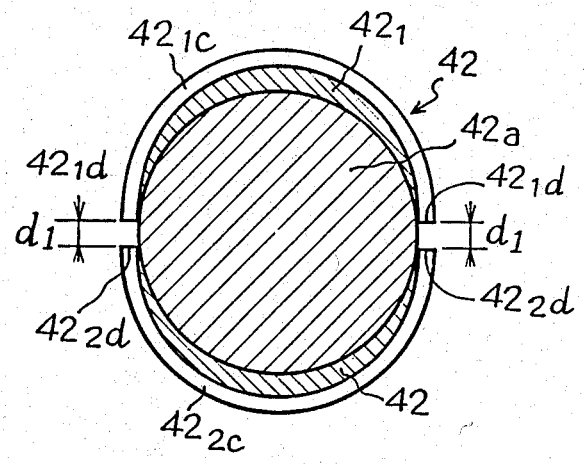
FIG. 12 is a view in section of the mandrel along line XII—XII of FIG. 11.

Reference will now be made to FIGS. 11 and 12 of the drawings, which illustrate a mandrel for making oval or elliptic objects.

In a cylindrical mandrel, such as the one which has just been described, it is easy to remove the tube, wound in contiguous turns, from the mandrel. If the mandrel is smooth, it suffices to slide the wound tube over the mandrel. If the mandrel comprises a helicoidal groove, the tube is withdrawn by unscrewing the tube winding.

On the other hand, there is a problem when the mandrel is of elliptic or oval cross section and the tube is wound in a groove, since the wound tube cannot be withdrawn if the mandrel is made in one piece.

According to the invention, and in order to produce tube windings of oval or elliptic contour, mandrel 42 is composed of a core 42*a* (see FIG. 12). The core may be, for example, cylindrical, comprising at one end a shaft end 42*b* (see FIG. 11) engaged in a bore 42*c* and held in place by means of a mechanical pin 32 engaged in holes 42*d*, 42*e*. The hole extends diametrically through core 42*a* and shaft end 42*b*. At its other end, the core comprises a coaxial conical housing 42*f*.

The mandrel also comprises two half-shells $41_1$, $42_2$ whose outer contour is, for example, substantially semi-elliptic and whose inner contour is substantially semicylindrical, so as to fit perfectly on the cylindrical core 42*a*. (See FIG. 12). The two half-shells are in opposition so that the mandrel is of elliptical cross section. The two half-shells extend over virtually the whole length of core 42*a* (see FIG. 11) and comprise, at their ends, semi-annular shoulders $42_1a$, $42_1b$- $42_2a$, $42_2b$ of substantially semi-circular outer contour. The two half-shells, $42_1$, $42_2$ are assembled on core 42*a* by means of a pin 44, engaged freely in a cylindrical conduit 42*g*, extending diametrically through core 42*a* and corresponding to two holes 42*h*, 42*j* made in the annular shoulders $42_1a$, $42_2a$. One of the purposes of pin 44 is to prevent rotation of the half-shells 42, $42_2$ around the core 42*a* during operation. A ring 45, comprising a first bore 45*a*, whose diameter is slightly larger than the diameter of core 42*a*, and a second concentric bore 45*b* slightly greater than the outer diameter of shoulders $42_1a$, $42_2a$, has for its function both to hold the two half-shells and to maintain pin 44 prisoner.

The depth of bore 45*b* is substantially equal to the length of said shoulders, $42_1a$, $42_2a$.

On the other side of the mandrel, a second ring 46, similar to ring 45, overlaps the shoulders $42_1b$, $42_2b$. This ring 46 comprises a bore 46*a* whose diameter is slightly larger than that of core 42*a* and a second concentric bore 46*b*, slightly larger than the outer diameter of shoulders $42_1b$, $42_2b$.

Ring 46 is maintained in position by a set screw 47, screwed in a tapped radial hole 46*c*, and abutting on the core 42*a*. Similarly, ring 45 is maintained by a screw 48 screwed in a tapped radial hole 45*c* and abutting on core 42*a*.

The two half-shells $42_1$, $42_2$ are spaced apart from each other by a distance $d_1$ substantially equal to the width of the tube. For example, for a cylindrical tube, $d_1$ would equal the tube's diameter.

On their periphery, the two half-shells comprise helicoidal grooves $42_1c$, $42_2c$, in which the tube is wound after issuing from die block 1.

In order to withdraw the tube winding from mandrel 42, screw 47 is loosened and ring 46 is made to slide on the core until shoulders $42_1b$, $42_2b$ are disengaged. Screw 48 is then loosened, and the other ring 45 is made to slide in order to disengage shoulders $42_1a$, $42_2a$ of the half-shells. Pin 44 is then removed, and core 42*a* is withdrawn by sliding it with respect to half-shells $42_1$, $42_2$. Said half-shells are then moved towards each other until their longitudinal edges $42_1d$, $42_2d$ come into contact with each other, and the tube winding may now be withdrawn.

Either one of the half-shells $42_1$, $42_2$ may comprise a radial mortise $42_1d$ for accomodating one of the drive catches 38 or 40, described with reference to FIGS. 13 and 14.

What is claimed is:

1. A device for forming a tube from a substantially planar material, comprising:

an inlet having a first cross-sectional configuration for receiving said planar material;

an outlet having a second cross-sectional configuration, said second cross-sectional configuration being smaller in area than said first cross-sectional configuration, and said second cross-sectional configuration being substantially of the same cross-sectional configuration as said tube;

a conduit having a longitudinal axis, connecting said inlet and said outlet for passing said planar material, said planar material being formed into said tube as it passes through said conduit, said conduit comprising a substantially continuously smooth surface having a continuously decreasing cross section extending from said inlet to said outlet, said planar material being substantially solely formed by contact with said surface so as to be formed into said tube; and means removably mounted on said inlet, said means defining a slit for receiving and centering said planar material with respect to the cross section of said inlet and for guiding said planar material during the passage of said planar material in said conduit.

2. The device of claim 1 wherein said conduit comprises generatrices which converge from said inlet towards said outlet.

3. The device of claim 1 wherein, at said inlet, said conduit has a width which is slightly greater than the width of said planar material.

4. The device of claim 1 wherein said inlet is substantially planar.

5. The device of claim 1, further comprising a notch located on said centering means to allow passage of a metal wire constituting a core about which said planar material winds while being formed into said tube by said channel.

6. The device of claim 1, wherein said inlet centering means has a width slightly greater than the width of said planar material.

7. The device of claim 5, wherein said centering means comprises at least two removable guide plates, each comprising a rectilinear edge, spaced apart from each other to form said slit, said plates being mounted on said notch.

8. The device of claim 7, wherein said slit lies in the vicinity of the longitudinal axis of said conduit.

9. The device of claim 1, wherein said centering comprises a removable guide plate with at least one rectilinear edge, the combination of said edge and said inlet defining the configuration of said receiving inlet.

10. The device of claim 7, wherein the distance by which said guide plates are spaced apart varies with said guide plates so as to make said distance adjustable.

11. The device of claim 10, wherein said distance is substantially equal to the thickness of said planar material.

12. A device for forming a tube from a substantially planar material, said planar material having lateral edges adapted to be formed into a longitudinal joint for forming said tube, comprising:

an inlet having a first cross section for admitting said planar material into said device;

an outlet having a second cross section for emitting said planar material from said device;

a channel communicating between said inlet and said outlet for forming said planar material into said tube as said planar material is drawn through said channel, said channel substantially solely engaging that surface of said planar material that forms the exterior surface of said tube, said planar material passing tangentially over substantially the entire length of said channel on only a portion of the total surface of said planar material; and means removably mounted on said inlet, said means defining a slit for receiving and centering said planar material with respect to said first cross section of said inlet and for guiding said planar material during the passage of said planar material in said channel.

13. The device of claim 12 wherein said channel converges as it extends from said inlet to said outlet.

14. The device of claim 12 wherein said inlet and said outlet lie in two planes substantially parallel to one another.

15. The device of claim 12 further comprising means for guiding said lateral edges of said planar material thereby providing said edges with a substantial parallel relationship.

16. The device of claim 15 wherein said guiding means are located within said channel.

17. The device of claim 12 wherein the angle of said channel is softened at said outlet.

18. The device of claim 16 wherein said guiding means comprises a fin extending parallel to the longitudinal axis of said channel and mounted on the interior surface of said channel.

19. The device of claim 12, comprising means located within said channel for engaging a portion of that surface of said planar material that forms the interior surface of said tube.

20. The device of claim 19 wherein said interior surface forming means is mounted substantially coaxially with said channel and has, at said outlet of said channel, a cross-sectional configuration substantially the same as said said outlet.

21. An apparatus for forming a tube from a substantially planar material, comprising:

a die for forming said tube from said planar material, said die comprising:

an inlet having a first cross-sectional configuration for receiving said planar material;

an outlet having a second cross-sectional configuration, said second cross-sectional configuration being smaller in area than said first cross-sectional configuration, and said second cross-sectional configuration being substantially of the same cross-sectional configuration as said tube;

a conduit having a longitudinal axis, connecting said inlet and said outlet for passing said planar material, said planar material being formed into said tube as it passes through said conduit, said conduit comprising a substantially continuously smooth surface having a continuously decreasing cross section extending from said inlet to said outlet, said planar material being substantially solely formed by contact with said surface so as to be formed into said tube; and means removably mounted on said inlet, said means defining a slit for receiving and centering said planar material with respect to the cross section of said inlet and for guiding said planar material during the passage of said planar material in said conduit;

means rotationally mounted adjacent said die for receiving said tube;

means for rotating said receiving means to produce a winding of said tube upon said receiving means, said receiving means adapted for storage and transportation of said tube; and means for translating said die in a direction substantially parallel to the longitudinal axis of said receiving means to provide a substantially uniform winding of said tube upon said receiving means.

22. The apparatus of claim 21 further comprising means for positioning said outlet of said die such that said tube is substantially tangential to the periphery of said receiving means as it is emitted from said outlet.

23. The apparatus of claim 21, wherein said translating means comprises a carriage mounting said die, said carriage being (i) rotatable about a horizontal axis substantially parallel to the longitudinal axis of said receiving means, and (ii) simultaneously translatable to provide substantially uniform winding of said tube upon said receiving means.

24. The apparatus of claim 21 wherein said receiving means comprises a mandrel, said mandrel being removable from said winding of said tube.

25. The apparatus of claim 24, wherein said mandrel comprises means for augmenting the cross-sectional area of said mandrel to facilitate the removal of said mandrel from said winding of said tube.

26. A device for forming a split tube from a flat and elongated strip, said strip having lateral edges adapted to be formed into a longitudinal joint for forming said tube, comprising:

an inlet having a cross section for receiving said strip;

an outlet for emitting said strip formed into said tube from said device;

a conduit having an interior surface connecting said inlet and said outlet, said strip being formed into said tube by contact substantially and solely between only one side of said strip and said interior surface of said conduit; and means removably mounted on said inlet, said means defining a slit for receiving and centering said strip with respect to the cross section of said inlet and for guiding said strip during the progression of said strip within said conduit.

27. The device of claim 26, wherein said one side of said strip is that surface of said strip that forms the exterior of said tube.

28. The device of claim 26, wherein said centering means comprises at least one guide plate with at least one rectilinear edge, the combination of said edge and of said inlet forming said slit.

29. The device of claim 26, wherein said centering means comprises two guide plates, each comprising at least one rectilinear edge, said plates being positioned and spaced apart from each other to form said slit.

* * * * *